US008459068B2

(12) United States Patent
Bolduan et al.

(10) Patent No.: US 8,459,068 B2
(45) Date of Patent: Jun. 11, 2013

(54) WASHING MACHINE COMPRISING A CONTROLLABLE WATER SUPPLY AND METHOD FOR OPERATING A WASHING MACHINE OF THIS TYPE

(75) Inventors: Edwin Bolduan, Berlin (DE); Gundula Czyzewski, Berlin (DE); Ingo Schulze, Panketal (DE); Horst Wiemer, Kleinmachnow (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 987 days.

(21) Appl. No.: 12/308,842

(22) PCT Filed: Jun. 11, 2007

(86) PCT No.: PCT/EP2007/055687

§ 371 (c)(1),
(2), (4) Date: Dec. 22, 2008

(87) PCT Pub. No.: WO2008/000612

PCT Pub. Date: Jan. 3, 2008

(65) Prior Publication Data

US 2009/0293202 A1 Dec. 3, 2009

(30) Foreign Application Priority Data

Jun. 29, 2006 (DE) ..... 10 2006 029 953

(51) Int. Cl.
*D06F 39/02* (2006.01)

(52) U.S. Cl.
USPC ..... 68/17 R; 68/17 A; 68/147; 68/212

(58) Field of Classification Search
None
See application file for complete search history.

(56) References Cited

U.S. PATENT DOCUMENTS

2004/0163425 A1* 8/2004 Kim et al. ..... 68/23.1
2004/0194514 A1* 10/2004 No et al. ..... 68/24

(Continued)

FOREIGN PATENT DOCUMENTS

DE 27 24 426 12/1978
DE 198 07 595 8/1999

(Continued)

OTHER PUBLICATIONS

Machine Translation of DE19908805 by Schulze et al., published Sep. 7, 2000.*

(Continued)

*Primary Examiner* — Michael Kornakov
*Assistant Examiner* — Ryan Coleman
(74) *Attorney, Agent, or Firm* — James E. Howard; Andre Pallapies

(57) ABSTRACT

A washing machine with a controllable fresh water intake for at least two detergent chambers which are located inside a housing of a detergent flushing device and which have an outlet for water or the mixture of detergent and water which opens onto a bottom surface of the housing which is inclined towards an outlet connection for a detergent supply line to the tub of the washing machine in which a laundry drum is mounted at least approximately horizontally, the washing machine comprising partial surfaces into which the bottom surface of the housing is divided, the partial surfaces including inclinations differing from the horizontal, the inclinations being differently directed to at least one of the other partial surfaces and each partial surface is assigned to at least one detergent chamber and includes an outlet connection in a lowest region of the partial surface.

9 Claims, 2 Drawing Sheets

U.S. PATENT DOCUMENTS

| | | | | |
|---|---|---|---|---|
| 2005/0210927 | A1* | 9/2005 | Kim et al. | 68/3 R |
| 2005/0274155 | A1* | 12/2005 | Namkung et al. | 68/17 R |
| 2005/0274156 | A1* | 12/2005 | Yang | 68/17 R |

FOREIGN PATENT DOCUMENTS

| | | | |
|---|---|---|---|
| DE | 199 08 805 | | 9/2000 |
| DE | 101 50 877 | | 7/2002 |
| DE | 101 38 067 | | 2/2003 |
| ES | 2 026 389 | | 4/1992 |
| FR | 2392163 | * | 12/1978 |

OTHER PUBLICATIONS

Machine Translation of FR2392163 by Bauknecht GMBH, published Dec. 22, 1978.*

International Search Report PCT/EP2007/055687.

* cited by examiner

WASHING MACHINE COMPRISING A CONTROLLABLE WATER SUPPLY AND METHOD FOR OPERATING A WASHING MACHINE OF THIS TYPE

BACKGROUND OF THE INVENTION

The invention relates to a washing machine with a controllable fresh water intake for at least two detergent chambers which are located inside a housing of a detergent flushing device and which have an outlet for the mixture of detergent and water which opens onto a bottom surface of the housing which is inclined towards an outlet connection for a detergent supply line to the tub of the washing machine in which a laundry drum is mounted at least approximately horizontally. The invention also relates to a method for operating such a washing machine.

Such a washing machine is known from DE 27 24 426 A1. However, this washing machine contains an additional separate detergent chamber for additives which are guided into the same region of the tub when a separate fresh water supply is switched on at a given time via a separate path, not over the bottom surface of the housing.

A method for operating a program-controlled washing machine is also known from DE 101 38 067 A1. In the known method, at the beginning of a washing process in a first step without movement of the laundry, a specific first amount of liquid without detergent is passed onto the laundry via a bypass directed onto the inner side of a collar, in a second step with movement of the laundry a specific second amount of liquid is passed together with detergent via the main detergent chamber between the laundry drum and the tub and in a third step with movement of the laundry, liquid without detergent is then fed directly via the bypass onto the laundry until the total influx of liquid is sufficient to completely wet the laundry. In this case, the bypass consists of a water pipe which branches off from the inlet channel to the pre-wash chamber and which can only carry a significantly smaller quantity of water than the inlet channel per se. The water supplied via this bypass of the collar is therefore only sufficient to wet the collar before the drum begins to rotate so that the laundry cannot be damaged by rubbing against the collar during the movement of the drum according to the object forming the basis of the known method.

Since only about 3.5 liter of water per minute can be supplied via such an inlet path, in the known method the supply of water until the total quantity has been completely filled is too tedious. The known inlet path lies inside narrow pipes in the cover area of a detergent flushing device and thus usually remains occupied by residual water in an airtight manner even after switching off the fresh water supply so that a special line must be provided between the tub and the detergent device to ventilate the tub during the addition of water and detergent.

However, in addition to supplying the detergent required for the main washing process, it is the object of the invention to provide as much as possible of the required total amount of liquid to the laundry as early as possible using simpler means and more rapidly than in the prior art.

BRIEF SUMMARY OF THE INVENTION

According to the invention, this object is achieved in a washing machine of the type specified initially by dividing the bottom surface into partial surfaces which have inclinations differing from the horizontal, which are differently directed to at least one of the other partial surfaces and each partial surface is assigned to at least one detergent chamber and has its own outlet connection in its lowest region.

In the manner according to the invention, the inlet path via a detergent chamber which is flushed before the main detergent chamber, can be successfully used for the rapid supply of water. This is also advantageous when this detergent chamber itself is filled with a detergent, possibly with a pre-wash agent. For a pre-wash the dosage of detergent is usually considerably smaller so that when the pre-wash agent is initially flushed in, there is no need to fear any discoloration of the laundry unlike the case when initial contact is made with the main detergent. In addition, most of the washing programs by far nowadays are operated without a pre-wash so that the so-called pre-wash chamber is usually not filled, i.e. is free. Consequently, if the laundry can be wetted very rapidly via the path with a fairly large quantity of detergent-free water, the subsequent addition of main detergent will be safe with regard to the colour fidelity of the laundry.

An advantageous further development of the invention has partial surfaces that are separated from one another by elevated ribs. As a result, larger quantities of water can be retained during a supply surge before going over onto partial surfaces from which they enter into an undesired detergent supply line.

In a washing machine comprising more than two detergent chambers, it is advantageous if at least two detergent chambers are assigned to a common partial surface. A larger differentiation of the inlet paths is not generally necessary; production costs can therefore be saved with this further development. For example, the chambers for pre-wash agent, which is almost never filled, and for additive can be assigned a common partial surface so that a large volume of water can be introduced into the laundry drum via this path in a short time. The main detergent chamber is allocated to the other partial surface—in this case only two partial surfaces are provided—from which the water-detergent mixture is guided between the laundry drum and the tub.

According to an advantageous development of the invention, the outlet connections are connected to the tub in different regions so that during the flushing-in of water and water-detergent mixture no undesirable feedback effects or mutual influencing occurs. It is particularly advantageous if the first of the outlet connections is guided at the rear region of the tub so that it is far away from the connection of the second of the outlet connections in the front region of the tub provided according to a likewise advantageous embodiment.

In this case, the first outlet connection is connected to the outer casing of the tub via a detergent supply line in an upper region which has the advantage that when the laundry drum is running, the water-detergent mixture falling onto the outer casing of the drum is immediately swirled around vigorously, mixed and distributed. It is furthermore advantageous if small quantities of water-detergent mixture pass through the flooding holes in the outer casing of the laundry drum and reach the laundry in small portions.

In a washing machine comprising a collar for liquid-tight connection of front openings in the tub and in the front wall of the machine housing, the second outlet connection is advantageously connected to the collar via a detergent supply line in an upper region.

A washing machine according to at least one of the preceding embodiments is advantageously operated according to claim 10 such that for supplying fresh water and detergent and for providing a total quantity of washing liquid in the course of the washing process, a first partial quantity of fresh water is guided directly onto the laundry via the pre-wash chamber, then whilst flushing out the main detergent chamber a second partial quantity is supplied as a mixture of fresh water and main detergent via a detergent supply line connected in the upper region of the tub on the outer casing of the laundry drum and a third partial quantity is guided directly onto the laundry as fresh water to make up the total quantity.

For the provision of a total quantity of rinsing solution in a rinsing section of a washing program, according to an advantageous further development of the method according to the invention, fresh water is guided exclusively via the pre-wash chamber directly onto the laundry, i.e. preferably by flushing-in through the collar.

For the provision of a total quantity of special treatment solution e.g. a solution of water and softener, a mixture of fresh water and additive is preferably supplied directly to the laundry via the additive chamber.

Empirically determined values should be selected for the various partial quantities of water supplied, which should preferably be between 4 and 7 liters for the first partial quantity, between 5 and 7 liters for the second partial quantity and at least 30 liters for the third partial quantity.

BRIEF DESCRIPTION OF THE DRAWINGS

The invention is explained in detail hereinafter with reference to exemplary embodiments shown in the drawings. In the figures.

DETAILED DESCRIPTION OF THE PRESENT INVENTION

Figure 1:
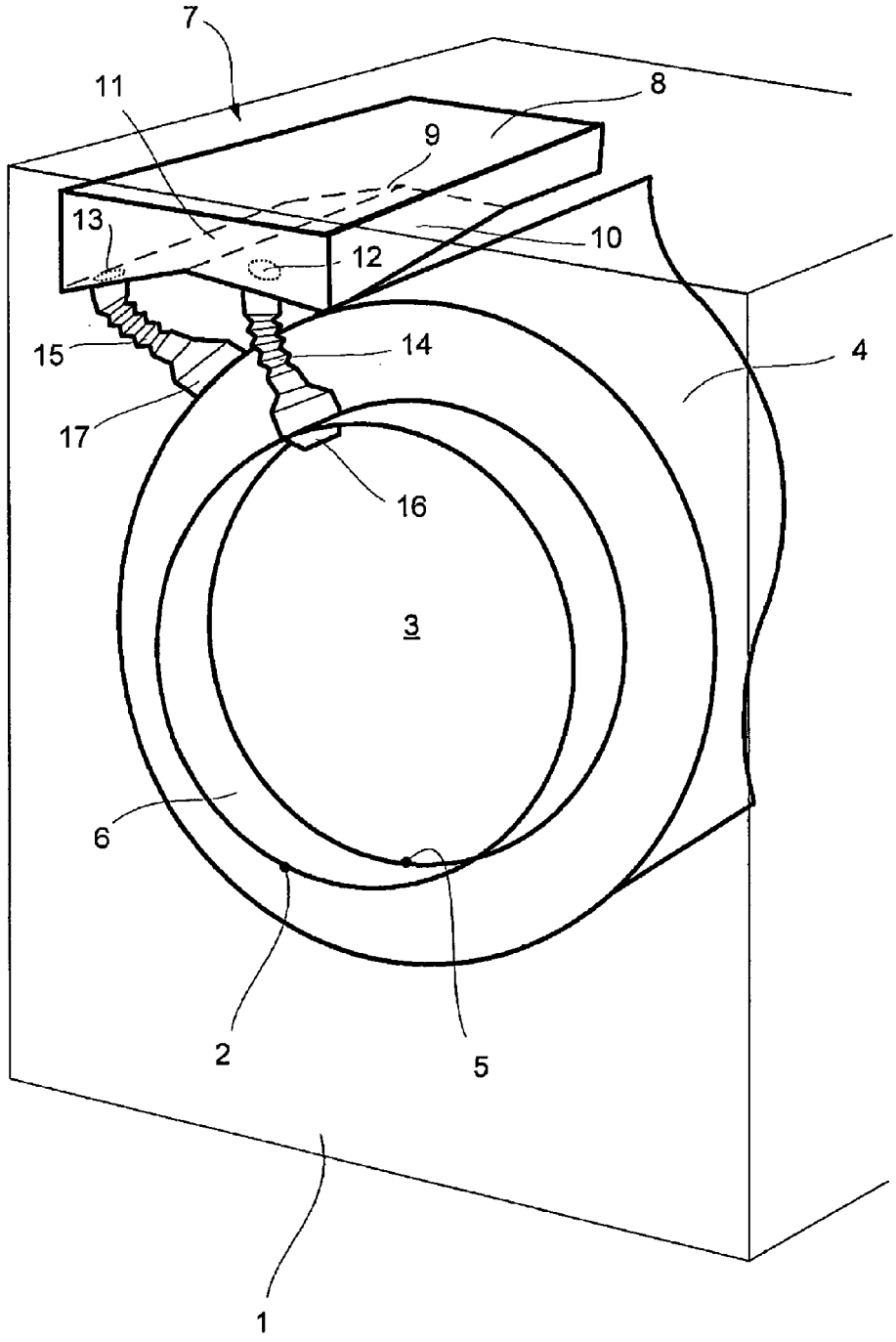
FIG. 1 is a front view of the relevant parts of a washing machine for the supply of water and detergent.

The thin lines indicate the outer boundaries of a washing machine housing 1 which has a filling opening 2 on the front side for loading and unloading the laundry into the laundry drum 3. The laundry drum 3—not visible in detail here—is enclosed by a tub 4 and is mounted so that it can rotate about a horizontal axis therein. The alignment of this bearing axis can deviate from the horizontal. In general an inclination of less than 15° raised towards the front is selected for this. Accordingly the tub 4 with its loading opening 5 is also inclined.

A collar 6 is provided for liquid-tight connection of the filling opening 2 in the machine housing 1 and the loading opening 5 in the tub 4, this collar allowing a certain mobility of the tub 4 relative to the machine housing 1.

Located in the upper region of the machine housing 1 is a detergent flushing device 7 which can be supplied from the back, not shown here, with fresh water via supply lines. For this purpose, the fresh water intake can be controlled at selected times or depending on the level by a program device via solenoid valves not shown.

Figure 3:
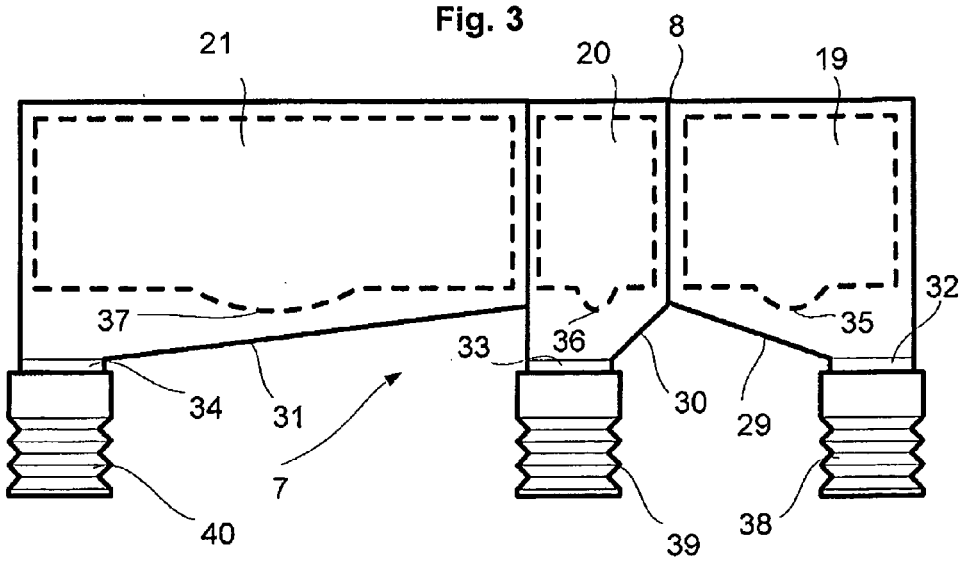

The detergent flushing device 7 has its own housing 8 accommodated in the machine housing 1 which accommodates a drawer with several chambers for different detergents or additives (can be seen better in FIG. 3). Located below the chambers of the inserted drawer is the bottom surface 9 of the housing 8 which in the prior art has a standard inclination towards an outlet connection. In any case, the bottom surface 9 is located as a collecting surface below the outlets of the detergent chambers. In the exemplary embodiment of the invention shown, the bottom surface 9 is divided into two partial surfaces 10 and 11, each having a different inclination from the other.

The partial surface 10, thus defined here, is located below the pre-wash and additive chamber and serves as a collecting surface for its contents or the fresh water supplied thereby. Its inclination runs towards the outlet connection 12 so that all the liquid supplied through the pre-wash chamber or the additive chamber reaches the outlet connection 12 via the bottom with the inclined partial surface. This is connected to an inlet 16 of the collar 6 by means of a detergent supply line 14.

The partial surface 11, thus defined here, is located underneath the main detergent chamber and serves as a collecting surface for the mixture of fresh water and main detergent. The inclination of the partial surface 11 runs towards the outlet connection 13 so that all the liquid by which means the main detergent is flushed out from this chamber reaches the outlet connection 13 via the bottom with the inclined partial surface 11. This is connected to the tub 4 by means of a detergent supply line 15 so that the inlet 17 guides the detergent-water mixture between the outer casings of the laundry drum 3 and the tub 4.

Figure 2:
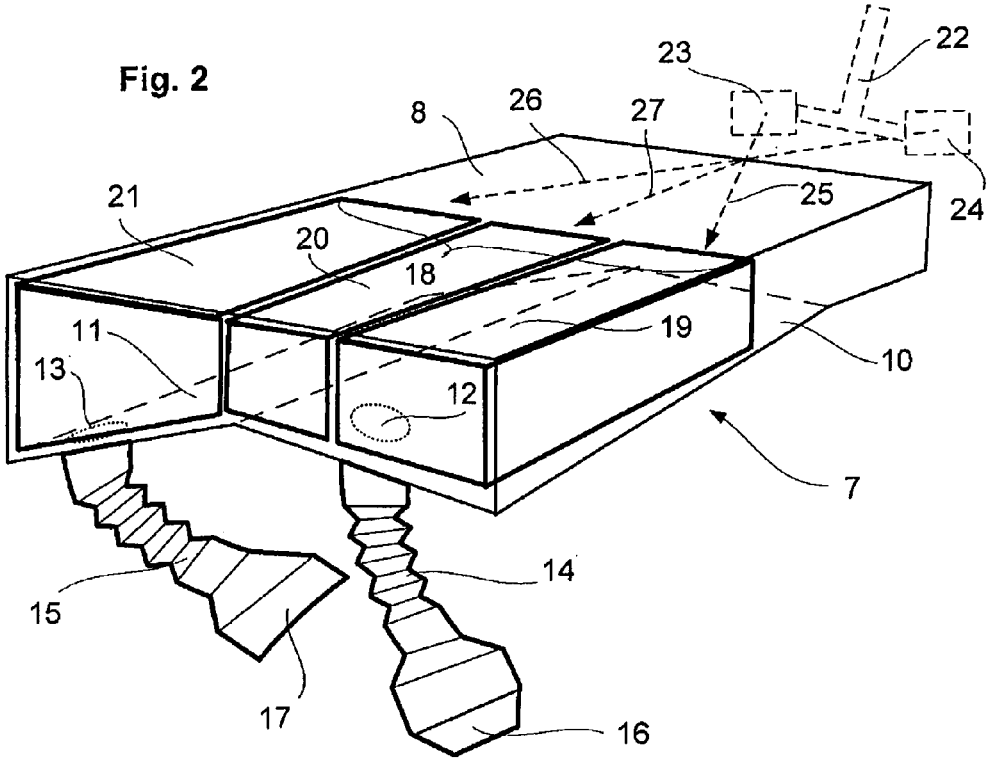
FIG. 2 is a schematic arrangement for a detergent flushing device and the supply of the respective partial quantities to the tub or the laundry and FIG. 3 is a schematic front view of another exemplary embodiment for a detergent flushing device.

The exemplary embodiment for a detergent flushing device 7 configured according to the invention, shown in FIG. 2, accommodates chambers 19, 20 and 21 combined to form a drawer 18 in its housing 8. The drawer can be pulled out towards the front for filling the chambers which are open at the top with individual detergent portions. In the operating position shown, outlets of each chamber 19 to 21 not visible here lie above the partial surfaces 10 and 11 of the housing bottom which are inclined towards the outlet connections 12 and 13. Thus, the outlets of chambers 19 and 20 lie above the partial surface 10 and the water supplied via said surface thus reaches the outlet connection 12 and from there passes via the detergent supply line 14 to the inlet 16 on the collar 6.

The outlet of the main detergent chamber 21 not visible here lies above the partial surface 11 and the main detergent-water mixture emerging from this chamber flows, driven by the inclination of the partial surface 11, towards the outlet connection 13 and from there via the detergent supply line 15 to the inlet 17 on the tub 4.

The fresh water from the domestic water supply 22, controlled by the solenoid valves 23 and 24 with single water jets 25 and 26, can reach the pre-wash chamber 19 or the main detergent chamber 21 with single water jets 25 and 26 which incorporate water surges in the usual manner to guard against back suction. However, if both solenoid valves 23 and 24 are opened at the same time, a single (middle)resulting jet 27 is formed from the jets 25 and 26 emerging simultaneously from the solenoid valves, and this reaches the chamber 20 for additives.

In the exemplary embodiment for a detergent flushing device 7 according to the invention shown in FIG. 2, the two partial surfaces 10 and 11 are separated from one another at their adjacent sides by a rib 28 so that water emerging from the chambers 19 to 21 in surges cannot pass over into the adjacent partial surface 11. This can ensure that water emerging from the chambers 19 and 20 only flows over the partial surface 10 to the outlet connection and not to the outlet connection 13 or, conversely, water from the chamber 21 does not flow to the outlet connection 12. Such a rib 28 can, however, merely be formed by the common regions of the partial surfaces 10 and 11 close to the boundary being provided with a greater slope than the remaining regions.

Unlike the exemplary embodiments so far, a detergent flushing device 7 according to FIG. 3 can also be configured in such a manner that there is provided for each detergent or additive chamber 19 to 21 its own partial surface 29 to 31 and its own outlet connection 32 to 34. By this means, water or a mixture of water and detergent/additive can be introduced in a differentiated manner at any time within a wash program in its own region of the tub 4 or the laundry drum 3. For this purpose, the outlet 35 to 37 of each chamber 19 to 21 is located above its own allocated partial surface 29 to 31.

Such a formation of the detergent flushing device 7 also allows variants when in fact three (or more) different supply lines should be provided in one type of washing machine but only two different supply lines should be provided in another type of washing machine as in the examples in FIGS. 1 and 2. In the latter case, only one combination of the detergent supply lines 38 and 39 is required and these can then open jointly, for example, in the inlet 16. The detergent supply line 40 is then guided to the tub 4 similar to the detergent supply line 15.

The washing machine according to the invention has a plurality of advantages compared with the prior art. Thus, the function of the flushing measures for the stored detergent is more reliable because a suitable amount of water according to the consistency can be provided for the flushing of detergents without needing to take account of other functions. Sine the water required for the main wash process is supplied rapidly, the laundry moved in the laundry drum is optimally protected and brought into contact as fast as possible with well distributed detergent. As a result, the active washing process can begin earlier and the wash process and the subsequent rinsing processes can be kept short such as cannot be achieved by other methods. The rinsing processes therefore proceed more vigorously. Overflowing of the flushing device can be avoided because one of the outlet connections is certainly free for draining excess quantities of water. Ventilation of the tub 4 is provided without an additional ventilation line because one of the two detergent supply lines is guaranteed to be unoccupied. In addition, the ventilation is considerably more reliable because the cross-section of the unoccupied detergent supply line is in any case larger than an additional ventilation line possibly between the detergent flushing device and a high part of a discharge line, as is usual in the prior art.

The invention claimed is:

1. A washing machine with a controllable fresh water intake for at least two detergent chambers which are located inside a housing of a detergent flushing device and which have an outlet for water or the mixture of detergent and water which opens onto a bottom surface of the housing which is inclined towards an outlet connection for a detergent supply line to the tub of the washing machine in which a laundry drum is mounted at least approximately horizontally, the housing comprising partial surfaces into which the bottom surface of the housing is divided, the partial surfaces of the housing including inclinations differing from the horizontal, the inclination of one of the partial surfaces being different than the inclination of another of the partial surfaces, and each partial surface is assigned to at least one detergent chamber, the housing including a first single dedicated outlet connection for a first detergent chamber provided to one of the partial surfaces of the bottom surface and a second single dedicated outlet connection for a second detergent chamber provided to another one of the partial surfaces of the bottom surface, wherein each inclined partial surface has a higher end and a lower end, and each higher end leads directly to each respective single dedicated outlet.

2. The washing machine according to claim 1 wherein the partial surfaces are separated from one another by elevated ribs.

3. The washing machine according to claim 1 and further comprising more than two detergent chambers wherein the at least two detergent chambers are assigned to a common partial surface of the partial surfaces.

4. The washing machine according to claim 3 wherein the detergent flushing device comprises a first chamber for prewash agent, a second chamber for main detergent and a third chamber for an additive and wherein the first chamber and the third chamber are assigned to a common partial surface of the partial surfaces.

5. The washing machine according to claim 1 wherein washing machine includes a tub and the first and second outlet connections are connected to the tub in different regions.

6. The washing machine according to claim 5 wherein one of the outlet connections is guided at a rear region of the tub.

7. The washing machine according to claim 5 wherein one of the outlet connections is guided in a front region of the tub.

8. The washing machine according to claim 5 wherein the first outlet connection is connected to an outer casing of the tub using a detergent supply line in an upper region of the tub.

9. The washing machine according to claim 5 and further comprising a collar for liquid-tight connection of front openings of the tub and the housing wherein the second outlet connection is connected to the collar using a detergent supply line in an upper region of the tub.

* * * * *

UNITED STATES PATENT AND TRADEMARK OFFICE

CERTIFICATE OF CORRECTION

PATENT NO. : 8,459,068 B2
APPLICATION NO. : 12/308842
DATED : June 11, 2013
INVENTOR(S) : Bolduan et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1469 days.

Signed and Sealed this
Eighth Day of September, 2015

Michelle K. Lee

Michelle K. Lee
*Director of the United States Patent and Trademark Office*